US006364618B1

(12) United States Patent
Moreno

(10) Patent No.: US 6,364,618 B1
(45) Date of Patent: Apr. 2, 2002

(54) FAN BODY ASSEMBLY

(75) Inventor: Eleobardo Moreno, St. John, IN (US)

(73) Assignee: Lakewood Engineering & Mfg. Co., Chicago, IL (US)

( * ) Notice: Subject to any disclaimer, the term of this patent is extended or adjusted under 35 U.S.C. 154(b) by 0 days.

(21) Appl. No.: 09/496,780

(22) Filed: Feb. 3, 2000

(51) Int. Cl.[7] ..... F04D 29/70

(52) U.S. Cl. ..... 416/247 R; 416/244 R; 415/213.1; 415/214.1; 403/13; 403/326; 403/329

(58) Field of Search ..... 416/244 R, 246, 416/247 R; 415/213.1, 214.1, 208.2, 211.2; 403/13, 326, 329; 248/188.8, 188.9, 677

(56) References Cited

U.S. PATENT DOCUMENTS

| | | | | | |
|---|---|---|---|---|---|
| 2,100,994 | A | | 11/1937 | Cohen | |
| 3,446,429 | A | * | 5/1969 | Suzuki et al. | 416/247 R |
| 4,120,615 | A | * | 10/1978 | Keem et al. | 415/214.1 |
| 4,486,144 | A | * | 12/1984 | Hung | 416/247 R |
| 4,599,042 | A | * | 7/1986 | Colliver | 415/214.1 |
| 4,872,399 | A | | 10/1989 | Chaney | |
| 4,927,324 | A | | 5/1990 | Coup et al. | |
| D309,944 | S | | 8/1990 | Chiu | |
| D312,124 | S | | 11/1990 | Coup et al. | |
| 5,073,088 | A | | 12/1991 | Peng | |
| 5,118,252 | A | | 6/1992 | Chaney | |
| 5,141,397 | A | * | 8/1992 | Sullivan | 415/214.1 |
| D329,089 | S | | 9/1992 | Coup et al. | |
| RE34,551 | E | | 2/1994 | Coup et al. | |
| 5,342,174 | A | | 8/1994 | Litvin | |
| 5,342,175 | A | * | 8/1994 | Patton | 416/247 R |
| 5,352,094 | A | | 10/1994 | Peng | |
| 5,368,445 | A | | 11/1994 | Litvin et al. | |
| 5,484,223 | A | * | 1/1996 | Saito | 403/326 |
| 5,653,417 | A | * | 8/1997 | DeBarber et al. | 248/677 |
| 5,699,601 | A | * | 12/1997 | Gilliam et al. | 403/329 |
| D408,907 | S | | 4/1999 | Moreno | |
| 6,183,204 | B1 | * | 2/2001 | Chang | 416/246 |

FOREIGN PATENT DOCUMENTS

| | | | | |
|---|---|---|---|---|
| GB | 2088013 A | * | 6/1982 | 403/13 |
| JP | 62-20693 A | * | 1/1987 | 416/244 R |

OTHER PUBLICATIONS

Lakewood Engineering & Mfg. Co.; *Lakewood Fans Brochure*, 1996.

* cited by examiner

*Primary Examiner*—Christopher Verdier
(74) *Attorney, Agent, or Firm*—Wallenstein & Wagner, Ltd.

(57) ABSTRACT

A fan body assembly having a housing assembly and an electric motor mounted to the housing is disclosed. The housing includes two grill members each having a vented wall and a peripheral side wall. The grill members are secured to one another by a fastener assembly which has a projection extending from the inner surface of one of the side walls which engages a mating receiver attached to the other sidewall. Spaced securing members are positioned from the inner surface of the first sidewall and include a sloped surface to guide the mating receiver into engagement with the projection. A lip extends from one of the sidewalls and mates with the inner surface of the other sidewall such that the sidewalls abut to form a substantially smooth transition. Unidirectional foot members are easily inserted into the base of the fan assembly to provide support.

25 Claims, 5 Drawing Sheets

FAN BODY ASSEMBLY

DESCRIPTION

1. Technical Field

The present invention relates to portable fan assemblies, and specifically to an improved fastener assembly for a fan assembly.

2. Background of the Invention

Fan devices, such as portable electric fans and heaters, are typically made up of numerous parts that define a housing that is ventilated with an air intake area and an air out-flow area. Typically, the air intake is made up of a rear grill structure and the air out-flow area includes a front grill structure.

One difficulty of manufacturers of fan devices is the assembly of the housing and ease of manufacture in securing the front and rear grill. Typical assembly of such devices have traditionally included fastening the grills together with mechanical fasteners such as screws or rivets, or by use of adhesives. Such methods have resulted in significant labor and manufacturing costs, complexity in the manufacturing process, and difficult removability of a grill cover for cleaning of the inner housing. One other type of prior devices includes an assembly as depicted in FIG. 7, with a rear grill body (A) having an inner body (A1) engaged with a lip (B1) of the front grill (B). This type of an assembly may be engaged by inserting the front grill into a cuff (C) of the rear grill (A) such that the lip (B1) deforms as it passes beyond the inner body (A1). This type of assembly, however, requires additional cost of the material forming the circumferential inner body (A1) and the circumferential lip (B1). Also, this type of assembly has the disadvantage of recessing the front grill (B) into the cuff (C), also requiring additional cost of material and creating an appearance that may be undesirable.

Therefore, there is a need for an improved assembly for a fan device with improved securement of the housing grill components.

Also, there is a need for an improved and simplified leg or stand assembly for a portable fan device. Traditional leg assemblies include feet-like bodies that are inserted into an opening in the base of the fan device. Prior art devices, however, are capable of being inserted incorrectly, thereby detracting from the appearance of the device and from the user's satisfaction.

SUMMARY OF THE INVENTION

In view of the insufficiencies discussed above, it is an object of the invention to provide a fan assembly having a fastener assembly in which a projection snaps into a mating receiver.

It is another objective of the present invention to provide a fan assembly having a housing formed of two grill members which attach by a fastening assembly having mating parts.

It is a further object of the present invention to provide a fan assembly having connecting grills with sidewalls which abut to form a substantially smooth transition.

It is yet another object of the present invention to provide a fan assembly having foot members which are unidirectional and provide a secure base of support.

It is yet a further object of the present invention to provide a fan assembly in which a plurality of fastener assemblies operate to easily and securely attach a first and second grill member to one another.

In accordance with the above objectives, a fan assembly is provided with a housing and an electric motor mounted to a grill member. The housing is formed of two grill members. Each grill member includes a vented wall for air circulation, and a peripheral sidewall. The sidewalls mate and are secured to one another by a fastener assembly.

The fastener assembly comprises a projection on the inside surface of one of the sidewalls which mates with a mating receiver on the other sidewall. Securing members may be positioned in spaced relation with the inner surface of the first sidewall to position the mating receiver into engagement with the projection. The fastener assembly snaps into engagement by slight deformation of a portion of the sidewall and provides an easily assembled secure union, preferably without the use of mechanical fasteners such as screws or rivets or the use of adhesive. A plurality of such fastener assemblies are preferably spaced around the periphery of the sidewalls.

One of the sidewalls may be provided with a lip which extends from the edge of the sidewall, and mates with the inner surface of the other sidewall such that the edges of the sidewall abut and form a substantially smooth transition for a generally smooth outer wall.

The fan assembly is further provided with foot members which are fitted into the base portion of the fan assembly with a mating geometry to the geometry of the insertion portion of the base, such that the foot members may be inserted in only one position. Thus, the possibility for orienting the foot members incorrectly is eliminated. Enhanced support for the fan assembly is provided by the foot members extending a distance toward the direction opposite to the air flow of the fan.

Other features and advantages of the invention will be apparent from the following specification taken in conjunction with the following drawings.

DETAILED DESCRIPTION OF THE PREFERRED EMBODIMENT

Figure 1:
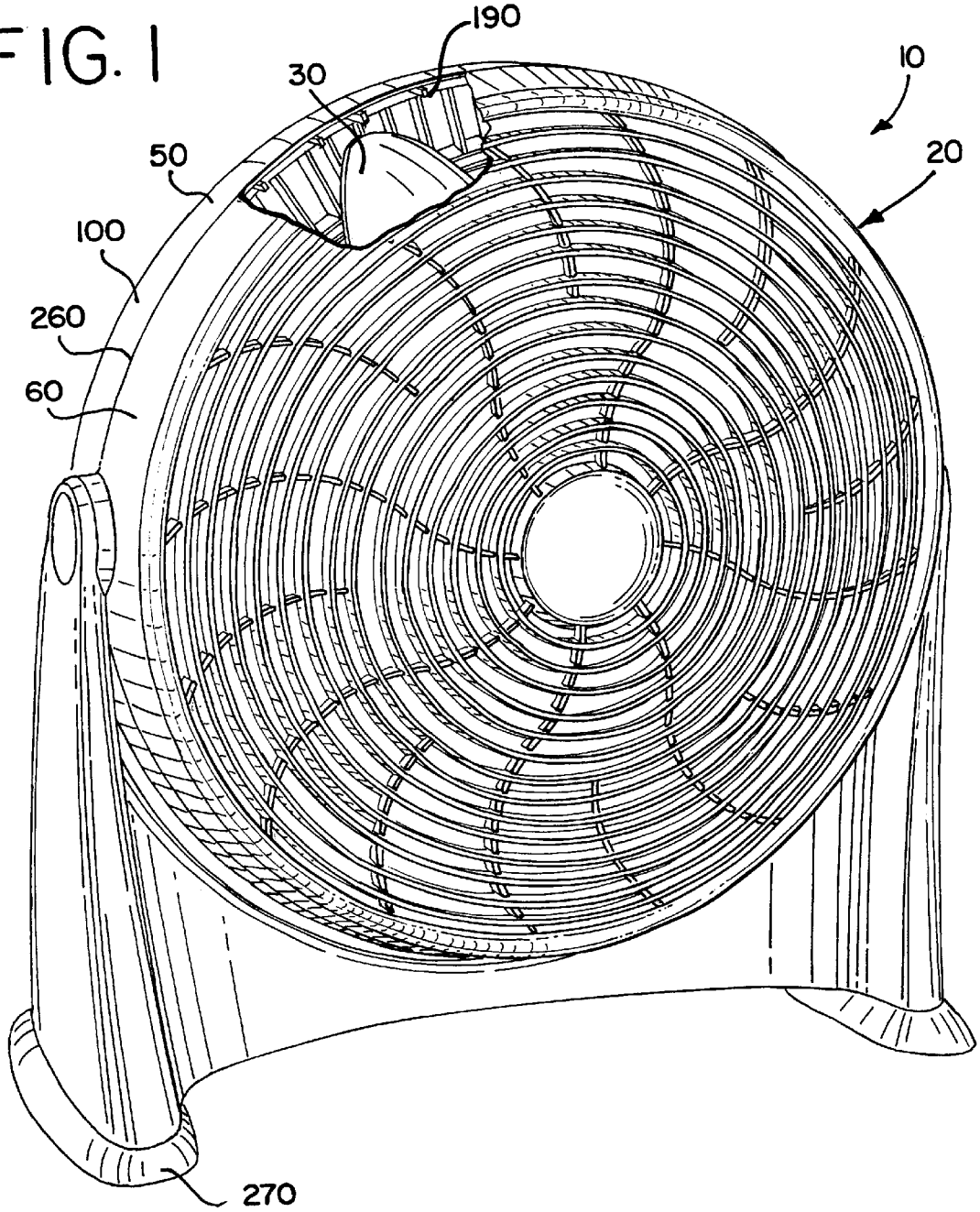
FIG. 1 is a perspective view of the fan assembly of the present invention.
Figure 2:
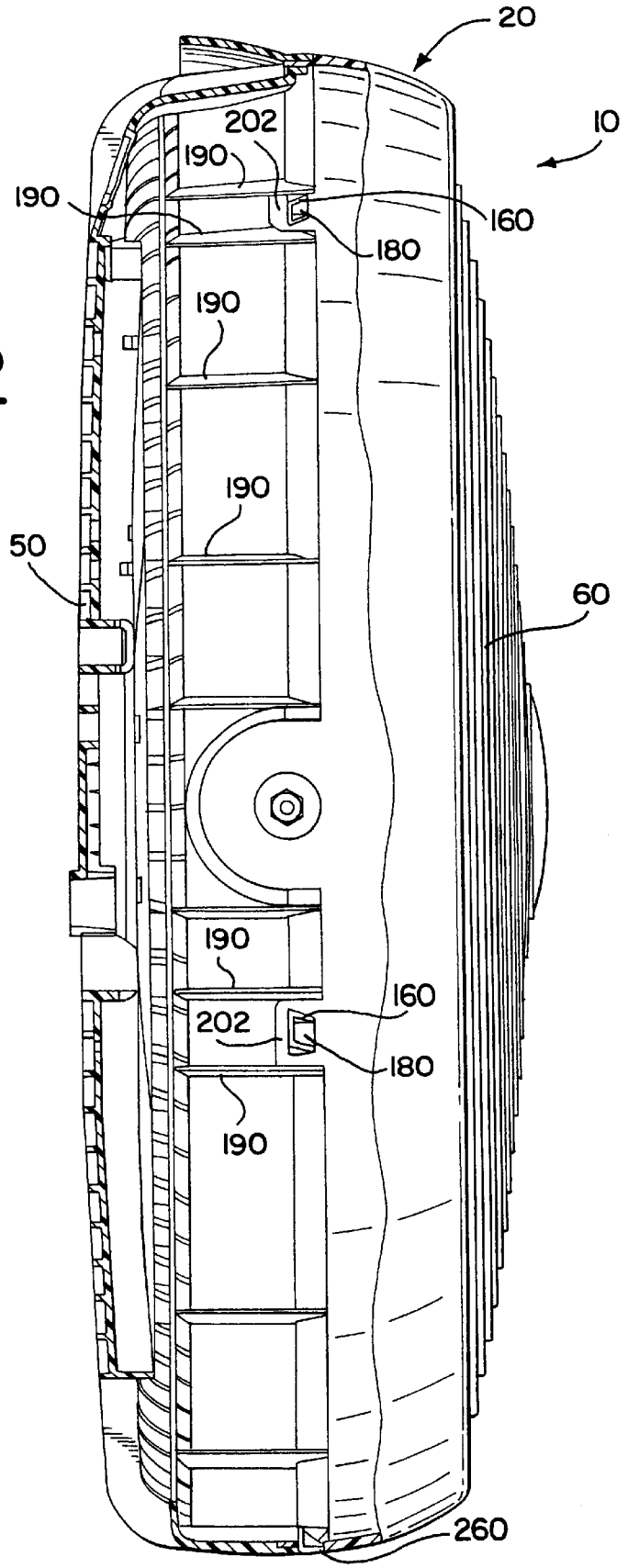
FIG. 2 is a side view of the fan assembly of the present invention.
Figure 3:
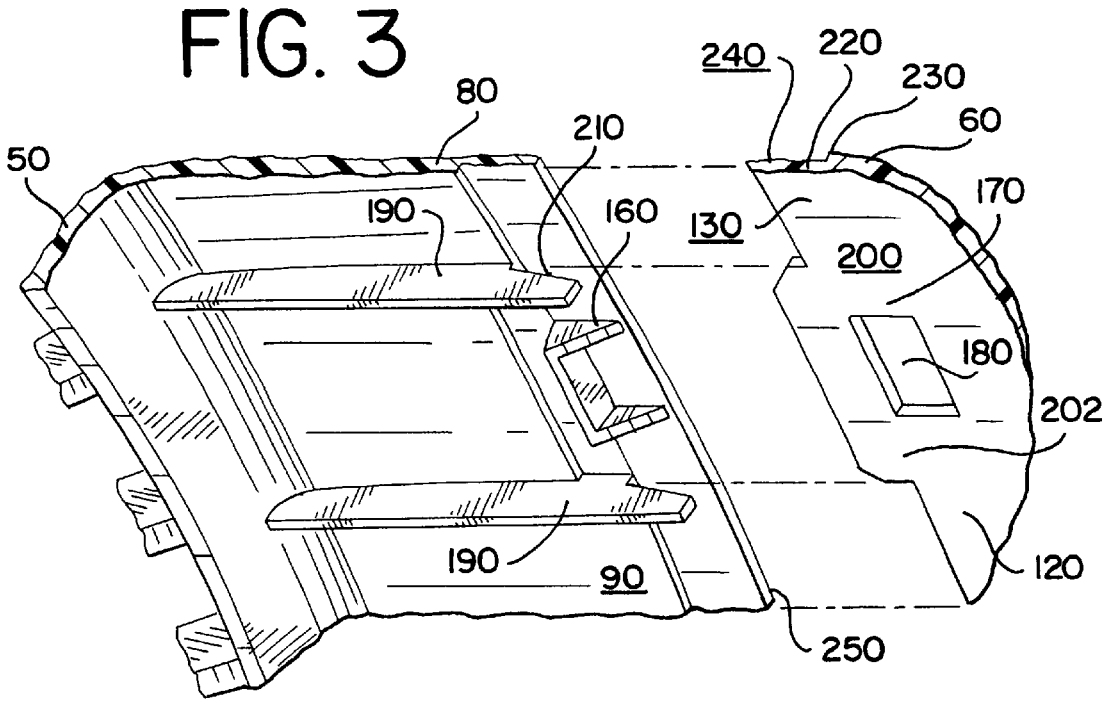
FIG. 3 is an exploded view of the fastener assembly of the present invention.
Figure 4:
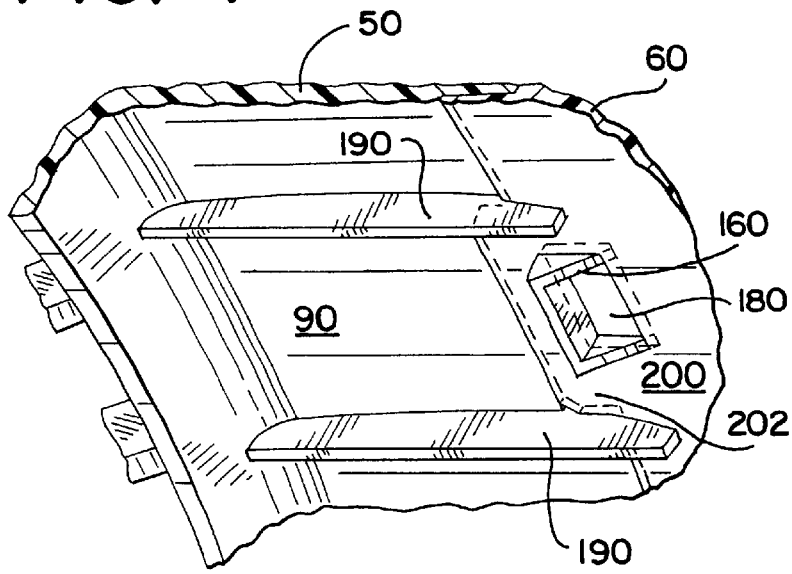
FIG. 4 is a cut-away view of the fastener assembly of the present invention.
Figure 5:
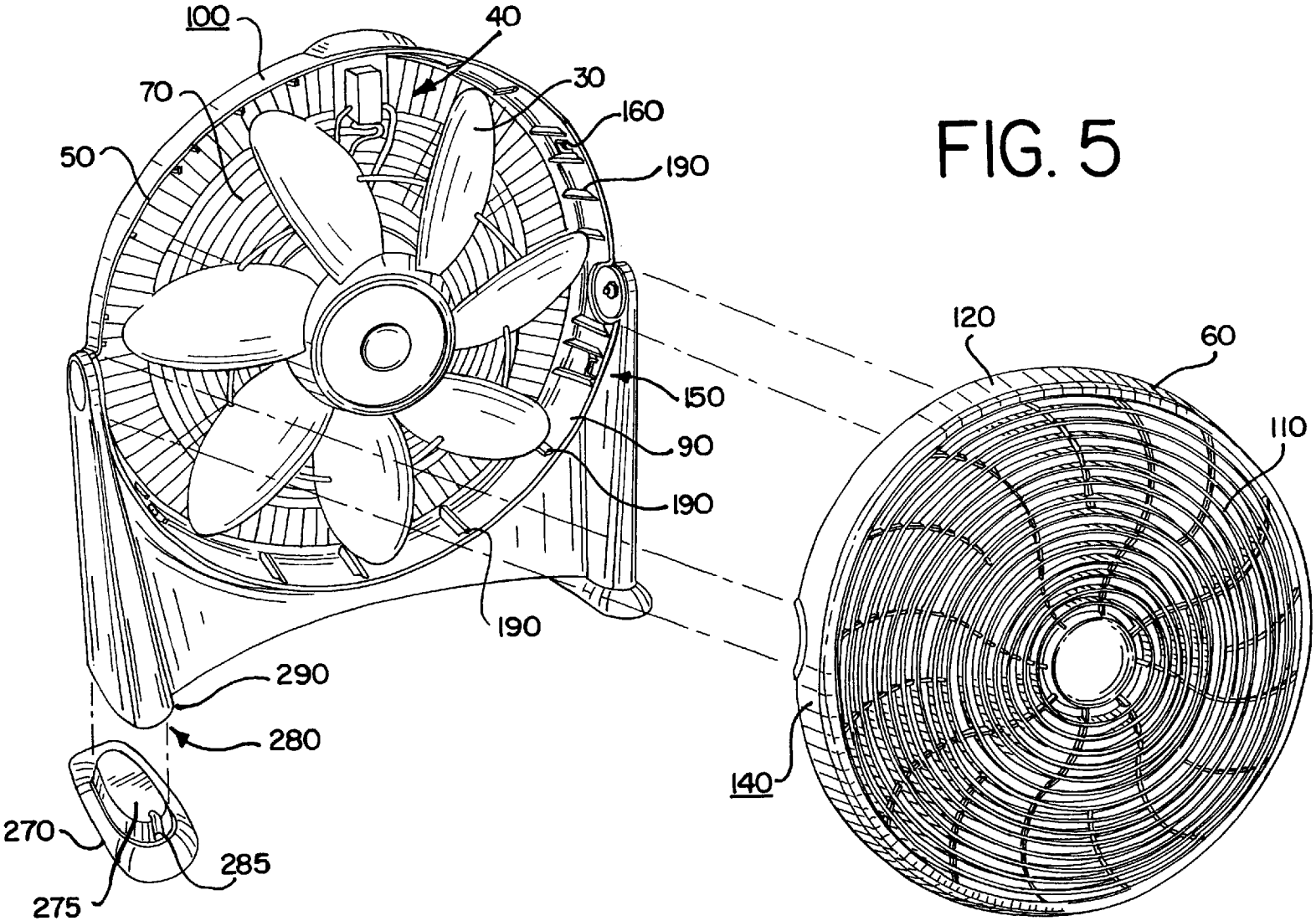
FIG. 5 is an exploded perspective view of the fan assembly of the present invention.
Figure 6:
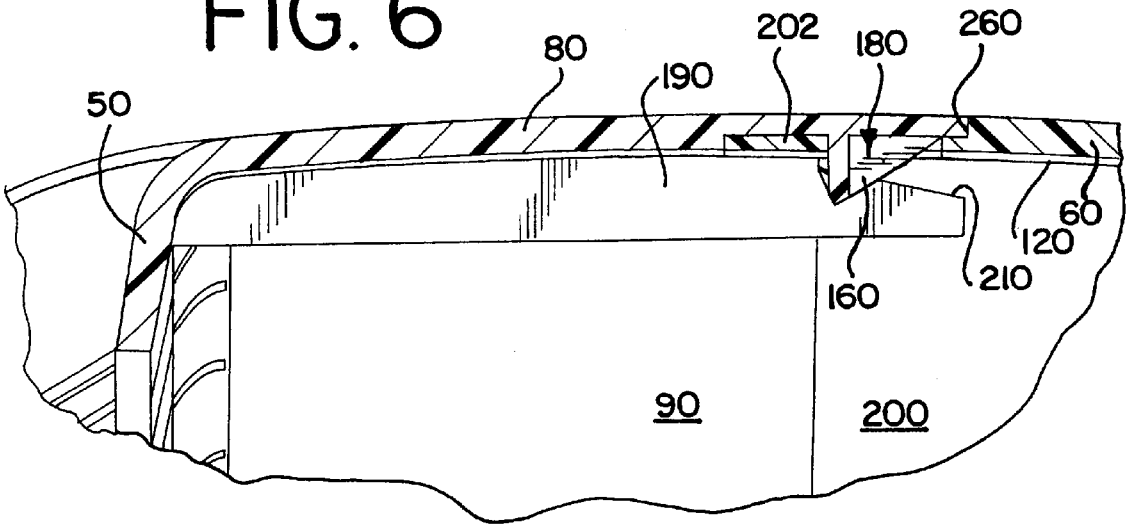
FIG. 6 is a cross-sectional side view of the fastener assembly of the present invention.
Figure 7:
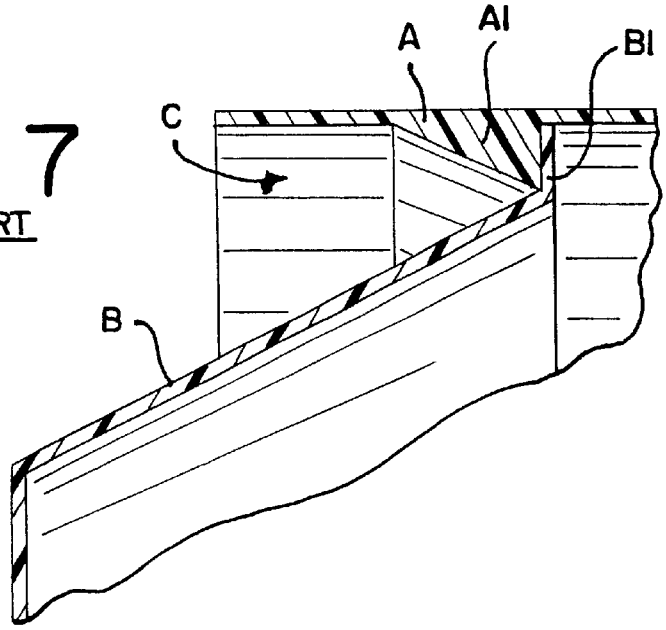
FIG. 7 PRIOR ART
FIG. 7 is a partial cross-sectional side view of interface of parts of a prior art fan device.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The portable fan assembly 10 of the present invention has a fan housing 20 and an electric motor mounted within the housing 20 for driving a blade assembly 30. The housing 20 has an inner chamber 40 defined by a first grill member 50 and a second grill member 60. The first grill member 50 has a vented wall 70 and a first sidewall 80 having an inner surface 90 and an outer surface 100. The sidewall 80 is preferably a peripheral sidewall having a regular shape, such as an annular or rounded shape, a rectangular shape, or a rectangular shape with rounded corners.

The second grill member 60 has a vented wall 110 and a second sidewall 120 having an inner surface 130 and an outer surface 140. Either of the first or second grill members 50, 60 may serve as a back or a front grill member. An electric motor is preferably mounted to one of the grill members 50 or 60, and connected to the blade assembly 30. In the preferred embodiment, the motor is mounted to the back grill, which is permanently secured with the base of the fan assembly. In this manner of arrangement, the front grill is secured by the means of the present invention of a fastener assembly 150, without the use of traditional fasteners such as screws or rivets, without the use of adhesive.

The first grill member 50 and the second grill member 60 are connected by a fastener assembly 150. The fastener assembly 150 comprises at least one projection 160 extending toward the inner chamber 40 from the inner surface 90 of the first sidewall 80, and a mating receiver 170 on the second sidewall 120 having an opening 180 engaged with the projection 160. The fastener assembly 150 preferably includes one or more securing members 190 in spaced relation with the inner surface 90 of the first sidewall 80 in generally close proximity with the projection 160 and the mating receiver 170. The securing member 190 is preferably in a position adapted to engaged with the opposing sidewall (the sidewall 120 of the second grill member 60) on the inner surface 200 of the sidewall 120, immediately adjacent the receiver 170. In the preferred embodiment, a securing member 190 is positioned on each side of an extended body 202 of the sidewall 120, adapted to provide a passageway for guiding the extended body 202. The securing members 190 are positioned relative to the projection 160 as to be adapted to provide a surface 210 generally opposed to the projection 160 such that deflection of the sidewall 120 of the second grill member 60 is limited or controlled during connection of the first grill member 50 and the second grill member 60. In this arrangement, the securing member 190 acts as a stop to restrain the sidewall 120 when the first 50 and second 60 grill members are secured together by engagement of the fastener assembly 150.

Also, in the preferred embodiment, a plurality of securing members 190 are provided in generally evenly-spaced relationship to one another, thereby maintaining the sidewall of the opposing grill member in fixed position around the entire extent of the sidewall. The securing members 190 preferably have a sloped upper surface 210 to make sloping contact with the opposing sidewall and to guide engagement of the mating receiver 170 into engagement with the projection 160.

The second sidewall 120 preferably comprises an annular or peripheral lip 220 extending from an edge 230 of the second sidewall 120, the lip 220 having an outer surface 240 which is recessed relative to the outer surface 140 of the second sidewall 120 and mates with the inner surface 90 of the first sidewall 80. The edge 230 of the second sidewall 120 preferably abuts an edge 250 of the first sidewall 80 such that the outer surfaces form a substantially smooth outer surface transition, or interface 260.

The fan assembly 10 preferably comprises a plurality fastener assemblies 150 arranged around the periphery of the sidewalls 80, 120.

The mating receiver 170 is preferably a tab or extension which protrudes from the second sidewall 120 or the lip 220, and is preferably integral with the lip 220.

The portable fan assembly 10 preferably includes a removable foot member 270 which is insertable into a receiving portion 280 of abase 290 of the fan assembly 10. The receiving portion 280 has a specific geometry, and the foot member 270 has an insertable portion 275 with an outer geometry adapted to fit into mating geometry of the receiving portion 280, such that the mating of the geometry of the insertable portion 275 and the geometry of the receiving portion 280 are compatible for only one arrangement. By this mating geometry arrangement, the foot 270 can only be inserted one way by the user to avoid incorrect assembly. In addition, foot has a vertical slot 285 that is adapted to align with an inwardly directed projection within the receiving portion 280 of the base 290. This arrangement of a mating vertical slot 285 and the inwardly directed projection allows for the insertable portion 275 to pass into the receiving portion 280 as the inwardly directed projection passes through the vertical slot 285 of the insertable portion 275. There are preferably two such foot members 270, and the foot members include a base of support which extends beyond the base 290 of the fan assembly 10.

While the specific embodiments have been illustrated and described, numerous modifications come to mind without significantly departing from the spirit of the invention, and the scope of protection is only limited by the scope of the accompanying claims.

What is claimed is:

1. A portable fan assembly having a fan housing and an electric motor mounted within the housing for driving a blade assembly, comprising:

the housing having an inner chamber defined by a first grill member and a second grill member;

the first grill member having a vented wall and a first side wall having an inner surface and an outer surface;

the second grill member having a vented wall and a second side wall having an inner surface and an outer surface;

the first grill member and the second grill member being connected by a fastener assembly comprising:

at least one projection extending toward the inner chamber from the inner surface of the first side wall;

a mating receiver on the second side wall adapted to receive the at least one projection passing into said receiver; and at least two securing members in spaced relation with the inner surface of the first side wall, each securing member having a surface opposing the inner surface of the first side wall and each positioned on opposite sides of and immediately adjacent to the receiver, the securing members further having sloped upper surfaces for guiding the mating receiver into engagement with the at least one projection.

2. The portable fan assembly of clam 1, wherein one of the first or second sidewalls comprises an extending lip having an outer surface recessed relative to the outer surface of the sidewall and mates with the inner surface of the other of the first or second sidewalls.

3. The portable fan assembly of claim 2, wherein an edge of the outer surface of the one of the first or second sidewalls abuts against an edge of the other of the first or second sidewalls, and wherein the outer surfaces of the first and second sidewalls form a substantially smooth transition.

4. The portable fan assembly according to claim 1, further comprising a plurality of fastener assemblies spaced around the perimeter of said grill members.

5. The portable fan assembly of claim 1, wherein the mating receiver comprises a tab extending from the outer sidewall of the second outer surface and a mating opening for engaging the at least one projection.

6. A portable fan assembly having a fan housing and an electric motor mounted within the housing for driving a blade assembly, comprising:

the housing having an inner chamber defined by a first grill member and a second grill member;

the first grill member having a vented wall and a first annular sidewall having an inner surface and an outer surface;

the second grill member having a vented wall and a second annular sidewall having an inner surface and an outer surface;

the first grill member and the second grill member being connected by a fastener assembly comprising at least one projection extending toward the inner chamber from the inner surface of the first side wall, and a mating receiver on the second side wall having an opening engaged with the at least one projection;

wherein the second annular sidewall comprises an annular lip extending from the second sidewall, the lip having an outer surface which is recessed relative to the outer surface of the second sidewall and mates with the inner surface of the first sidewall.

7. The portable fan assembly according to claim 6, wherein an edge of the outer surface of the second sidewall abuts against an edge of the outer surface of the first sidewall, and wherein the outer surfaces of the first and second sidewalls form a substantially smooth transition.

8. The portable fan assembly according to claim 7, wherein the mating receiver extends from the lip.

9. The portable fan assembly of claim 6, wherein the fastener assembly further comprises two securing members in spaced relation with the inner surface of the first sidewall and having a surface generally opposed to the inner surface of said sidewall.

10. The portable fan assembly according to claim 9, wherein the securing members each have a sloped upper surface adapted to engage the opposing member sidewall and guide the mating receiver into engagement with the at least one projection.

11. The portable fan assembly according to claim 6, wherein the motor is mounted to the vented wall of the first grill member.

12. The portable fan assembly according to claim 6, further comprising a removable foot member with an insertable portion adapted to be received into a receiving portion of a base of the fan assembly, said insertable portion having a geometry along an extent that is adapted to mate with a geometry of an extent of the receiving portion.

13. The portable fan assembly according to claim 12, wherein the foot member has a vertical passageway adapted to receive an inward projection of the receiving portion.

14. A portable fan grill assembly comprising:

a first and a second grill member each having a vented wall and an outer peripheral wall with an inner surface, the second grill member connectable to the first grill member by a fastener assembly to define a housing having an inner chamber, the fastener assembly comprising:

at least one projection disposed on the inner surface of the first grill member; and an opening within the sidewall of the second grill member adapted to engage the at least one projection when the first and second grill members are in a connected position;

wherein a portion of the sidewall adjacent to the opening is inwardly deflectable within the inner chamber in response to sliding contact with the at least one projection during connection of the first and second grill members.

15. The portable fan grill assembly of claim 14, wherein the outer peripheral walls of the first and second grill members each have an outer surface in substantial alignment with each other in the connected position.

16. The portable fan assembly of claim 14, further comprising at least one securing member disposed on the inner surface of the first grill member and adjacent to the at least one projection, wherein the at least one securing member limits the inward deflection of the portion of the sidewall of the first grill member during connection of the first and second grill members.

17. The portable fan assembly of claim 14, wherein the portion of the sidewall adjacent to the opening includes a tab portion that deflects inwardly in response to sliding contact with the at least one projection during connection of the first and second grill members.

18. The portable fan assembly of claim 14, wherein the outer peripheral walls of the first and second grill members each include a lip defined by a reduced material thickness that is less than that of the respective peripheral wall.

19. The portable fan assembly of claim 18, wherein the lip of the outer peripheral wall of the first grill member defines an offset mating surface that is offset from the inner surface of the wall.

20. The portable fan assembly of claim 19, wherein the outer peripheral walls each include an outer surface and wherein the lip of the outer peripheral wall of the second grill member defines an offset mating surface that is offset from the outer surface of the wall.

21. The portable fan assembly of claim 20, wherein the mating surfaces of the lips of the first and second outer peripheral walls mate with each other in the connected position.

22. A fastener assembly for fastening parts of a portable fan to each other, the assembly comprising:

at least one projection disposed on an inner surface of a first fan part; and an opening within a sidewall of a second fan part adapted to engage the projection when the first and second fan parts are in a connected position;

wherein a portion of the sidewall adjacent to the opening is deflectable in response to sliding contact with the at least one projection during connection of the first and second fan parts.

23. The fastener assembly of claim 22, wherein the outer peripheral walls of the first and second fan parts each have an outer surface in substantial alignment with each other in the connected position.

24. The fastener assembly of claim 22, further comprising at least one securing member disposed on the inner surface of the first fan part and adjacent to the at least one projection, wherein the at least one securing member limits the inward deflection of the portion of the sidewall of the first fan part during connection of the first and second fan parts.

25. The fastener assembly of claim 22, wherein the portion of the sidewall adjacent to the opening includes a tab portion that deflects inwardly in response to contact with the at least one projection during connection of the first and second fan parts.

* * * * *